US011649632B2

(12) United States Patent
Richards

(10) Patent No.: US 11,649,632 B2
(45) Date of Patent: May 16, 2023

(54) BUCKLING-RESTRAINED BRACES AND FRAMES INCLUDING THE SAME

(71) Applicant: Paul William Richards, Orem, UT (US)

(72) Inventor: Paul William Richards, Orem, UT (US)

( * ) Notice: Subject to any disclaimer, the term of this patent is extended or adjusted under 35 U.S.C. 154(b) by 0 days.

(21) Appl. No.: 17/047,962

(22) PCT Filed: Apr. 18, 2019

(86) PCT No.: PCT/US2019/028040

§ 371 (c)(1),
(2) Date: Oct. 15, 2020

(87) PCT Pub. No.: WO2019/204558

PCT Pub. Date: Oct. 24, 2019

(65) Prior Publication Data

US 2021/0189727 A1 Jun. 24, 2021

Related U.S. Application Data

(60) Provisional application No. 62/660,478, filed on Apr. 20, 2018.

(51) Int. Cl.

| | |
|---|---|
| ***E04C 3/02*** | (2006.01) |
| ***E04C 3/293*** | (2006.01) |
| *E04C 3/04* | (2006.01) |

(52) U.S. Cl.

CPC ..... *E04C 3/293* (2013.01); *E04C 2003/026* (2013.01); *E04C 2003/0447* (2013.01); *E04C 2003/0465* (2013.01)

(58) Field of Classification Search

CPC ..... E04C 3/293; E04C 2003/026; E04C 2003/0447; E04C 2003/0465

(Continued)

(56) References Cited

U.S. PATENT DOCUMENTS 4,071,996 A * 2/1978 Muto ..... E04G 23/0218 264/35
4,467,584 A * 8/1984 Crites ..... E04F 13/0733 52/489.1

(Continued)

FOREIGN PATENT DOCUMENTS

WO WO-2013103878 A1 * 7/2013 ..... E04C 3/00

OTHER PUBLICATIONS

International Search Report and Written Opinion from International Application No. PCT/US2019/028040 dated Jul. 1, 2019.

(Continued)

*Primary Examiner* — Brent W Herring
(74) *Attorney, Agent, or Firm* — Dorsey & Whitney LLP

(57) ABSTRACT

An example buckling restrained brace ("BRB") includes a casing exhibiting a hollow cross-sectional shape defining an interior region. The BRB also includes a core and at least a portion of the core is disposed in the interior region of the casing. For example, the casing may exhibit a first length and the core may exhibit a second length that is greater than the first length such that a portion of the core extends from the casing. The core is separated from the casing by an minimum gap distance along at least a portion of the first length of the casing and a corresponding portion of the second length of the core.

14 Claims, 4 Drawing Sheets

(58) Field of Classification Search
USPC ..... 52/837, 841, 834, 835, 650.1, 474, 479
See application file for complete search history.

(56) References Cited

U.S. PATENT DOCUMENTS

D279,608 S * 7/1985 Carey ..... D25/126
4,606,167 A * 8/1986 Thorne ..... E04B 1/944 52/364
4,912,901 A * 4/1990 Jerry ..... E04C 3/32 52/301
5,471,810 A * 12/1995 Sugisawa ..... E04C 3/04 52/847
6,009,683 A * 1/2000 Grewe ..... E04C 3/30 52/301
6,826,874 B2 * 12/2004 Takeuchi ..... E04H 9/0237 52/167.3
7,182,187 B2 * 2/2007 Mochimaru ..... F16F 9/303 188/297
7,185,462 B1 * 3/2007 Smelser ..... E04H 9/0237 52/638
7,305,799 B2 * 12/2007 Smelser ..... E04C 3/02 52/167.3
7,373,758 B2 * 5/2008 Tsai ..... E04H 9/0237 52/741.1
8,250,818 B2 * 8/2012 Tremblay ..... E04H 9/0237 52/167.3
8,590,258 B2 * 11/2013 Hinchman ..... E04H 9/0237 52/167.2
8,713,891 B2 5/2014 Carr et al.
9,016,007 B2 * 4/2015 Marinovic ..... E04H 9/024 52/167.3
9,157,251 B2 * 10/2015 Newman ..... E04B 1/92
9,447,596 B2 9/2016 Ichikawa et al.
9,540,812 B2 * 1/2017 Tsai ..... E04H 9/028
9,719,255 B1 8/2017 Ehsani
10,006,202 B2 * 6/2018 Kimura ..... E04B 1/98
10,519,658 B1 * 12/2019 Herron, III ..... E04C 3/34
2003/0205008 A1 * 11/2003 Sridhara ..... E04H 9/0237 52/167.3
2003/0222188 A1 * 12/2003 Smelser ..... E04C 3/02 248/188.91
2005/0257490 A1 * 11/2005 Pryor ..... E04H 9/14 52/834
2008/0016794 A1 * 1/2008 Tremblay ..... E04H 9/0237 52/167.4
2010/0005737 A1 * 1/2010 Tsai ..... E04H 9/0237 52/167.3
2012/0000147 A1 * 1/2012 Chou ..... E04H 9/0237 52/167.1
2012/0233955 A1 * 9/2012 Tsai ..... E04H 9/0237 52/653.1
2012/0266548 A1 * 10/2012 Tremblay ..... E04H 9/0237 52/167.3
2013/0067856 A1 * 3/2013 Woolstencroft ..... E04B 1/38 52/750
2013/0074440 A1 * 3/2013 Black ..... E04H 9/0237 52/704
2013/0139452 A1 * 6/2013 Tsai ..... E04B 1/98 52/655.1
2013/0152490 A1 * 6/2013 Hinchman ..... E04H 9/0215 29/897.3
2014/0059950 A1 * 3/2014 Marinovic ..... E04H 9/024 52/167.3
2015/0000228 A1 * 1/2015 Dusicka ..... E04G 23/0218 52/835
2016/0237711 A1 * 8/2016 Powell ..... E04H 9/027
2016/0251844 A1 * 9/2016 Allen ..... E04B 1/2403 52/834
2017/0198477 A1 * 7/2017 Ehsani ..... E04C 3/04
2017/0234012 A1 * 8/2017 Kimura ..... E04H 9/0237 52/835
2017/0335588 A1 * 11/2017 Douglas ..... E04H 9/0215
2020/0362585 A1 * 11/2020 Hou ..... E04H 9/021

OTHER PUBLICATIONS

U.S. Appl. No. 62/660,478, filed Apr. 20, 2018.

* cited by examiner

BUCKLING-RESTRAINED BRACES AND FRAMES INCLUDING THE SAME

CROSS-REFERENCE TO RELATED APPLICATIONS

This application is a U.S. nationalization of PCT International Application No. PCT/US2019/028040 filed on 18 Apr. 2019, which claims priority to U.S. Provisional Application No. 62/660,478 filed on 20 Apr. 2018, the disclosure of each of the foregoing applications is incorporated herein, in its entirety, by this reference.

BACKGROUND

Buckling restrained braces ("BRBs") are structural braces that are often used in buildings and other structures. BRBs are configured to withstand cyclical loading caused, for example, by earthquakes. Typically BRBs are most effective when they can resist equal or substantially equal magnitudes of tensile axial forces and compressive axial forces.

Generally, conventional BRBs include a core and a casing. The core may resist large tensile and compression axial forces. When in compression, the core is restricted from buckling by the casing. In an example, a convention BRB may include one or more cementitious materials (e.g., cement, grout, etc.) that at least substantially fill any gap between the core and the casing. However, the cementitious materials significantly increase the weight of the conventional BRB which in turn impacts fabrication, shipping, and installation costs.

In an example, some BRBs have been disclosed but not seen widespread use, that may include one or more protrusions extending therefrom or attached to the casing that extend between the core and the casing thereby eliminating the need for the BRB to include the cementitious materials. However, the protrusions can greatly increase the difficulty in manufacturing the conventional BRB. For instance, it may be necessary to form the casing from two or more pieces which are then attached together to allow the protrusions to be attached to a middle section of the casing which increases the time and energy required to form the conventional BRB.

In an example, a conventional BRB may increase the cross-sectional size of the core relative to the casing thereby significantly decreasing the gap between the core and the casing and eliminating the need for the BRB to include the cementitious materials. However, in such an example, increasing the cross-sectional size of the core relative to the case also increases the ability of the core to resist tensile axial forces. Increasing the ability of the core to resist tensile axial forces creates a dilemma since the cross-sectional size of the casing likewise needs to be increased such that the ability of the conventional BRB to resist tensile and compressive axial forces should be substantially equal. However, the increased cross-sectional size of the casing then requires the cross-sectional size of the core to be increased which starts the whole cycle of increasing cross-sectional sizes of the core and casing again.

As such, users and producers of BRBs continue to seek new and improved BRBs.

SUMMARY

In an embodiment, a BRB is disclosed. The BRB includes a casing exhibiting a hollow cross-sectional shape defining an interior region. The casing exhibits a first length. The BRB also includes a core disposed in the interior region of the casing. The core exhibits a generally I cross-sectional shape. The core exhibits a second length that is greater than the first length. The core is separated from the casing by an minimum gap distance along at least a portion of the first length of the casing and a corresponding portion of the second length of the core.

In an embodiment, a BRB is disclosed. The BRB includes a casing exhibiting a hollow cross-sectional shape defining an interior region. The casing exhibits a first length. The BRB also includes a core disposed in the interior region of the casing. The core exhibits a second length that is greater than the first length. The core is separate from the casing along at least a portion of the first length of the casing and a corresponding portion of the second length of the core by an minimum gap distance. The minimum gap distance is about 2% to about 49% of at least one outer dimension of the casing.

In an embodiment, a BRB is disclosed. The BRB includes a casing exhibiting a hollow cross-sectional shape defining an interior region. The casing exhibits a first length. The BRB also includes a core disposed in the interior region of the casing. The core exhibits a second length that is greater than the first length. The BRB further includes a plurality of bridge plates that each extend substantially between the core and the casing. The core is separated from the casing by an minimum gap distance along at least a portion of the first length of the casing and a corresponding portion of the second length of the core.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

Embodiments disclosed herein are directed towards BRBs and frames including BRBs. An example BRB includes a casing exhibiting a hollow cross-sectional shape defining an interior region. The BRB also includes a core and at least a portion of the core is disposed in the interior region of the casing. For example, the casing may exhibit a first length and the core may exhibit a second length that is greater than the first length such that a portion of the core extends from the casing. The core is separated from the casing by an minimum gap distance along at least a portion of the first length of the casing and a corresponding portion of the second length of the core.

The minimum gap distance is the distance between the core and the casing. The minimum gap distance is measured perpendicularly to a longitudinal axis of the casing and/or the core. Generally, any gap between the core and the casing is unoccupied space (e.g., occupied by air). When discussing the minimum gap distance, any protrusions extending from or attached to the casing are considered part of the casing and any protrusions extending from or attached to the core are considered part of the core.

Figure 1A:
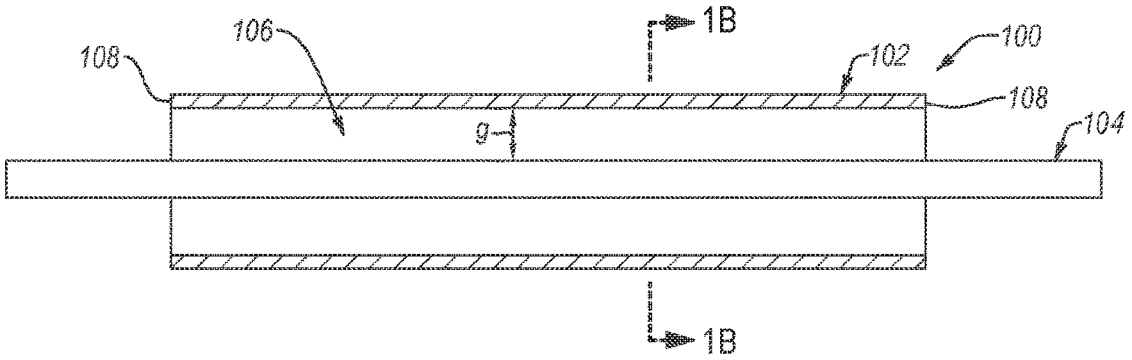
FIG. 1A is a partial cross-sectional view of a BRB, according to an embodiment.
Figure 1B:
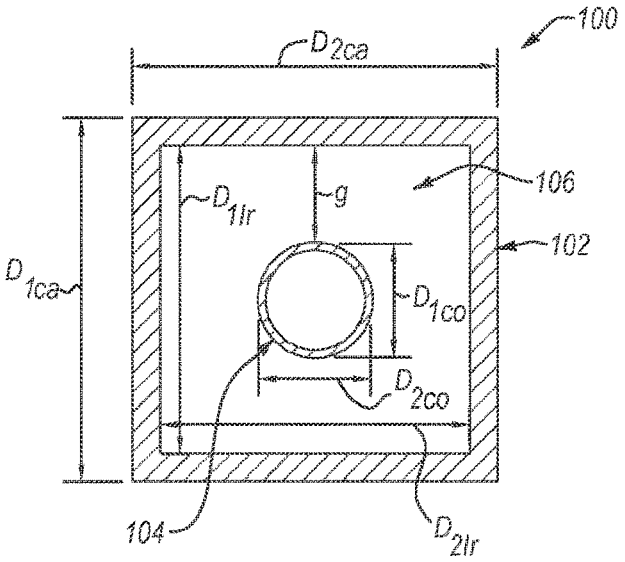
FIG. 1B is a cross-sectional view of the BRB taken along line 1B-1B shown in FIG. 1A, according to an embodiment.

FIG. 1A is a partial cross-sectional view of a BRB 100, according to an embodiment. FIG. 1B is a cross-sectional view of the BRB 100 taken along line 1B-1B shown in FIG. 1A, according to an embodiment. The BRB 100 includes a casing 102 and a core 104 disposed in the casing 102. For example, the casing 102 exhibits a generally hollow cross-sectional shape that allows the casing 102 to define an interior region 106. A portion of the core 104 is positioned within the interior region 106. The BRB 100 includes an minimum gap distance "g" between the casing 102 and the core 104.

The casing 102 may include any suitable casing. In an example, the casing 102 may include any suitable material. Generally, the casing 102 is formed from steel. However, the casing 102 may be formed from other materials, such as aluminum, without limitation. In an example, the casing 102 is formed from a single piece (e.g., is unitary), such as when the casing 102 is extruded or cold formed. However, the casing 102 may be formed from a plurality of pieces, such as a plurality of pieces that are welded together prior to forming the BRB 100.

The casing 102 exhibits a first length. In an embodiment, the casing 102 may exhibit a first length that is similar to a common length for casings of conventional BRBs. In such an embodiment, the casing 102 may exhibit a first length that is greater than 3 m, such as greater than about 6 m, greater than about 9 m, greater than about 12 m, or in ranges of 3 m to about 6 m, about 4.5 m to 7.5 m, about 6 m to about 9 m, about 7.5 m to about 10.5 m, or about 9 m to about 12 m. In an embodiment, the casing 102 may exhibit a first length that is less than a common length of casings of conventional BRBs. For example, the casing 102 may exhibit a length that is less than 3 m, such as less than about 2.5 m, less than about 2 m, less than about 1.5 m, less than about 1 m, or in ranges of about 1 m to about 2 m, about 1.5 m to about 2.5 m, or about 2 m to 3 m. It is currently believed that the minimum gap distance "g" between the casing 102 and the core 104 allows the casing 102 to exhibit a first length that is less than the common length of casings of conventional BRBs because the minimum gap distance "g" (e.g., the absence of cementitious material) allows for scaling down of the BRB 100.

The first length of the casing 102 may be selected based on a number of factors. In an example, the first length of the casing 102 may be selected based on the second length of the core 104. For example, the second length of the core 104 is selected to be greater than the first length of the casing 102 which allows the core 104 to protrude from the casing 102. The portions of the core 104 that protrude from both sides of the casing 102 allows the core 104 to be coupled to the rest of a frame (e.g., beams 322 and/or columns 324 of FIG. 3) while the casing 102 is only indirectly coupled to the frame via the core 104. In an example, the first length of the casing 102 may be selected based on needed ability of the casing 102 to resist compressive axial forces since the ability of the casing 102 to resist compressive axial forces is directly proportional to the inverse of the first length. It is noted that the needed ability of the casing 102 to resist compressive axial forces depends on the strength of the core 104 in tension (e.g., the yield strength of the ultimate tensile strength of the core 104) and the cross-sectional area of the core 104. In an example, the first length of the casing 102 may be selected based on the application of the BRB 100. For instance, when the BRB 100 is used in a frame for a building, the casing 102 may exhibit a first length that is the same or similar to the common lengths of conventional BRBs. However, the BRB 100 may be used in other applications (e.g., pallet racks or other large shelving, other general bracing of equipment such as. braces for piping or ducting feature) due to the reduced weight thereof compared to conventional BRBs exhibiting the same length and because the casing 102 can exhibit a length that is less than the common length of casings used in conventional BRBs. For instance, the casing 102 may exhibit a length of about 1 m to about 2.5 m when the BRB 100 is used in a pallet rack or other large shelving.

The casing 102 may exhibit a first outer casing dimension $D_{1Ca}$ and a second outer casing dimension $D_{2Ca}$. The first and second outer casing dimensions $D_{1Ca}$ and $D_{2Ca}$ are measured perpendicularly to a longitudinal axis of the casing 102 and the second outer casing dimension $D_{2Ca}$ is measured perpendicularly to the first outer casing dimension $D_{1Ca}$. In an embodiment, the first outer casing dimension $D_{1Ca}$ and the second outer casing dimension $D_{2Ca}$ are the same, such as when the casing 102 exhibits a hollow generally square cross-sectional shape or a hollow generally circular cross-sectional shape. In an embodiment, the first outer casing dimension $D_{1Ca}$ is different (e.g., greater) than the second outer casing dimension $D_{2Ca}$.

In an embodiment, the first outer casing dimension $D_{1Ca}$ and the second outer casing dimension $D_{2Ca}$ may be the same or substantially similar to a common outer casing dimensions of conventional BRBs. For example, the first outer casing dimension $D_{1Ca}$ and the second outer casing dimension $D_{2Ca}$ may be greater than 12.5 cm, greater than about 15 cm, greater than about 20 cm, greater than about 30 cm, greater than about 40 cm, or in ranges of 12.5 cm to about 20 cm, about 15 cm to about 30 cm, or about 20 cm to about 40 cm. However, in an embodiment, at least one of the first outer casing dimension $D_{1Ca}$ or the second outer casing dimension $D_{2Ca}$ may be less than a common outer casing dimension of conventional BRBs. For example, at least one of the first outer casing dimension $D_{1Ca}$ or the second outer casing dimension $D_{2Ca}$ may be less than about 12 cm, less than about 10 cm, less than about 7.5 cm, less than about 5 cm, less than about 2.5 cm, or in ranges of about 2.5 cm to about 7.5 cm, about 5 cm to about 10 cm, or about 7.5 cm to about 12 cm. At least one of the first outer casing dimension $D_{1Ca}$ or the second outer casing dimension $D_{2Ca}$ may be less that a common outer dimension of conventional BRBs due to the minimum gap distance "g" between the casing 102 and the core 104. For example, the minimum gap distance "g" may decrease the weight of the BRB 100 compared to conventional BRBs thereby allowing the BRB 100 to exhibit the relatively small first and/or second outer casing dimensions $D_{1Ca}$ and $D_{2Ca}$. Further, as previously discussed, the minimum gap distance "g" may allow the casing 102 to exhibit a relatively small first length. The relatively small first length increases the casing's 102 ability to resist compressive axial forces thereby decreasing the need to have a large outer cross-sectional dimension (e.g., the casing's 102 ability to resist compressive axial forces may proportional to the outer casing dimension).

The interior region 106 may exhibit a first interior region dimension $D_{1IR}$ and a second interior region dimension $D_{2IR}$. The first interior region dimension $D_{1IR}$ and the second interior region dimension $D_{2IR}$ may be measured perpendicularly to the first outer casing dimension $D_{1Ca}$ and the second outer casing dimension $D_{2Ca}$, respectively. In an embodiment, as shown, the first interior region dimension $D_{1IR}$ and the second interior region dimension $D_{2IR}$ are the same, such as when the casing 102 exhibits a hollow generally square cross-sectional shape or a hollow generally circular cross-sectional shape. In an embodiment, the first interior region dimension $D_{1IR}$ is different (e.g., greater) than the second interior region dimension $D_{2IR}$.

The first interior region dimension $D_{1IR}$ and the second interior region dimension $D_{2IR}$ may be less than the first outer casing dimension $D_{1Ca}$ and the second outer casing dimension $D_{2Ca}$, respectively, by at least about 2 mm, at least about 5 mm, at least about 7.5 mm, at least about 1 cm, at least about 1.5 cm, at least about 2 cm, at least about 3 cm, at least about 5 cm, or in ranges of about 2 mm to about 7.5 mm, about 5 mm to about 1 cm, about 7.5 mm to about 1.5 cm, about 1 cm to about 2 cm, about 1.5 cm to about 3 cm, or about 2 cm to about 5 cm. The difference between the first and second interior region dimensions $D_{1IR}$, $D_{2IR}$ and the first and second outer casing dimensions $D_{1Ca}$, $D_{2Ca}$, respectively, may be selected based on the needed ability of the casing 102 to resist compressive axial forces such that the BRB 100 resists both tensile and compressive axial forces equally or substantially equally.

As previously discussed, the core 104 exhibits a second length that is typically greater than the first length of the casing 102. In an embodiment, the second length of the core 104 is the similar to a common length for cores of conventional BRBs. For example, the second length of the core 104 may be greater than 3.05 m, such as greater than about 6 m, greater than about 9 m, greater than about 12 m, or in ranges of 3.05 m to about 6 m, about 4.5 m to 7.5 m, about 6 m to about 9 m, about 7.5 m to about 10.5 m, or about 9 m to about 12 m. In an embodiment, the core 104 may exhibit a second length that is less than about a common length of casing of conventional BRBs. For example, the casing 102 may exhibit a length that is less than about 3 m, such as less than about 2.5 m, less than about 2 m, less than about 1.5 m, less than about 1 m, or in ranges of about 1 m to about 2 m, about 1.5 m to about 2.5 m, or about 2 m to about 3 m. It is currently believed that the minimum gap distance between the casing 102 and the core 104 allows the core 104 to exhibit a second length that is less than the common length of cores of conventional BRBs.

The second length of the core 104 may be selected based on a number of factors. In an example, as previously discussed, the second length of the core 104 may be selected based on the first length of the casing 102. In an example, the first length of the core 104 may be selected based on the needed ability of the core 104 to resist compressive axial forces since the ability of the core 104 to resist compressive axial forces is dependent on the inverse of the second length squared. In an example, the second length of the core 104 may be selected based on the application of the BRB 100. For instance, when the BRB 100 is used in a frame for a building, the core 104 may exhibit a second length that is the same or similar to the common lengths of cores of conventional BRBs. However, the BRB 100 may be used in other applications due to the reduced weight thereof compared to conventional BRBs exhibiting the same length and because the BRB 100 can exhibit a length that is less than conventional BRBs. For instance, the core 104 may exhibit a second length of about 1 meter to about 2.6 m when the BRB 100 is used in a pallet rack or other large shelving.

As previously discussed, the second length of the core 104 may be greater than the first length of the casing 102. For example, the second length of the core 104 may be greater than the first length of the casing 102 by at least about 2.5 cm, at least about 5 cm, at least about 7.5 cm, at least about 10 cm, at least about 15 cm, at least about 20 cm, at least about 30 cm, at least about 40 cm, at least about 50 cm, at least about 75 cm, at least about 1 m, at least about 1.5 m, at least about 2 m, at least about 2.5 m, at least about 3 m, or in ranges of about 2.5 cm to about 7.5 cm, about 5 cm to about 10 cm, about 7.5 cm to about 15 cm, about 10 cm to about 20 cm, about 15 cm to about 30 cm, about 20 cm to about 40 cm, about 30 cm to about 50 cm, about 40 cm to about 75 cm, about 50 cm to about 1 m, about 75 cm to about 1.5 m, about 1 m to about 2 m, or about 1.5 m to about 3 m. The difference between the first length of the casing 102 and the second length of the core 104 may be selected based on the length of the core 104 required to attach BRB 100 to a frame.

Referring to FIG. 1B, in an embodiment, the core 104 may include a hollow structural section, such as a tube (e.g., steel tube) having a hollow generally circular cross-sectional shape. The hollow generally circular cross-sectional shape of the core 104 exhibits a high moment of inertia relative to certain types of cores, such as a substantially similar solid generally circular cross-sectional shape and plates. The high moment of inertia of the core 104 makes the core 104 more resistant to buckling which, in turn, may allow the BRB 100 to include a smaller casing 102 than if the core 104 exhibited another shape exhibiting a lower moment of inertia.

Figure 1C:
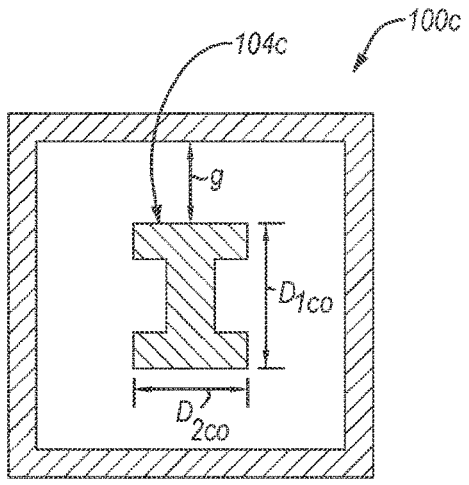
FIG. 1C is a cross-sectional view of a BRB, according to an embodiment.

However, it is noted that the core 104 used in the BRB 100 may exhibit other cross-sectional shapes. FIG. 1C is a cross-sectional view of a BRB 100*c* that, except as otherwise disclosed herein, is the same as or substantially similar to the BRB 100 of FIGS. 1A and 1B, according to an embodiment. For example, the BRB 100*c* includes a core 104*c* that is a rolled I-beam. The core 104*c* exhibits a high moment of inertia. The high moment of inertia of the core 104*c* allows the core 104*c* to exhibit may of the same properties as the core 104 shown in FIG. 1B.

Some conventional BRBs include cruciform or double cruciform beams that exhibit a moment of inertia that is comparable to the core 104*c*. However, the cruciform or double cruciform beams require a significant amount of welding to form which may require a significant amount of time required to form the cruciform or double cruciform beams. However, the rolled I-beam that forms the core 104*c* does not require welding to form and may be readily available. As such, the BRB 100*c* may be formed much quicker, more efficiently, and cheaper than the conventional BRBs that include cruciform or double cruciform beams.

Figure 1D:
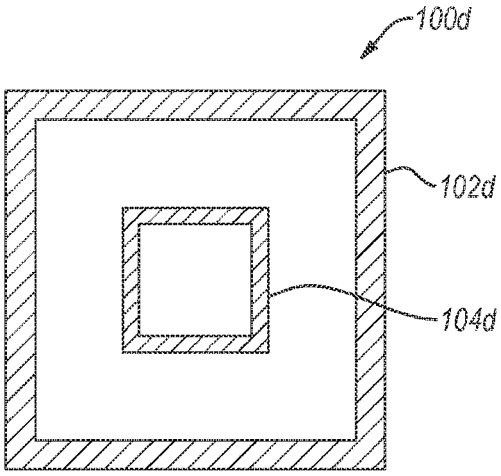
FIGS. 1D-1I are cross-sectional views of different BRBs, according to different embodiments
Figure 1E:
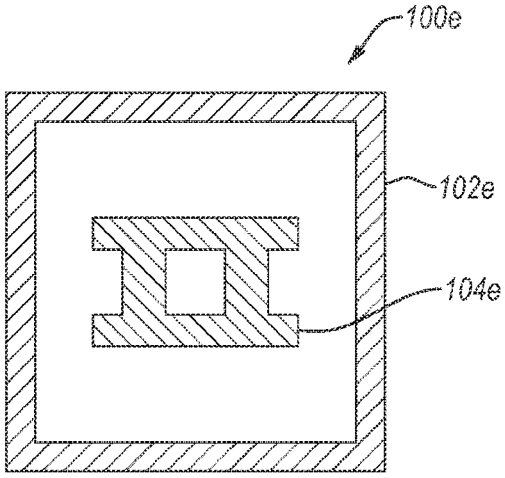
Figure 1F:
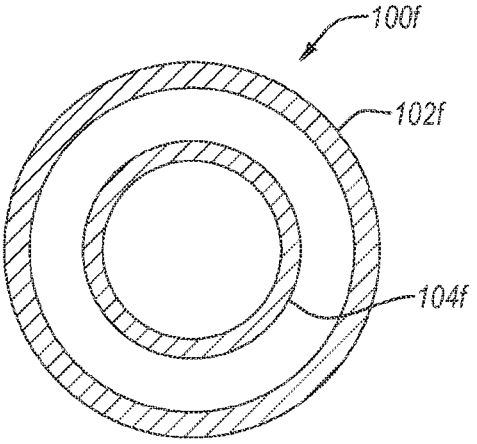
Figure 1G:
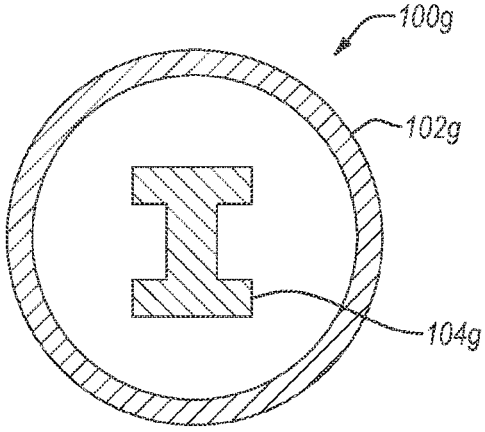
Figure 1H:
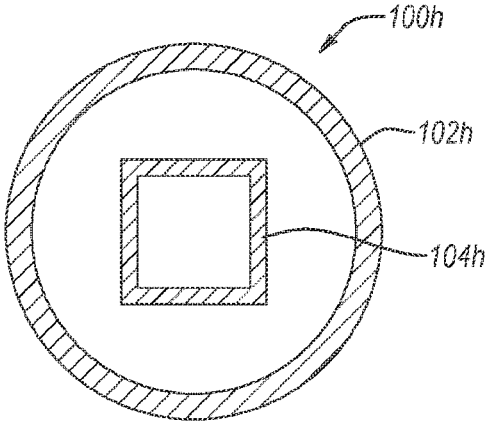
Figure 1I:
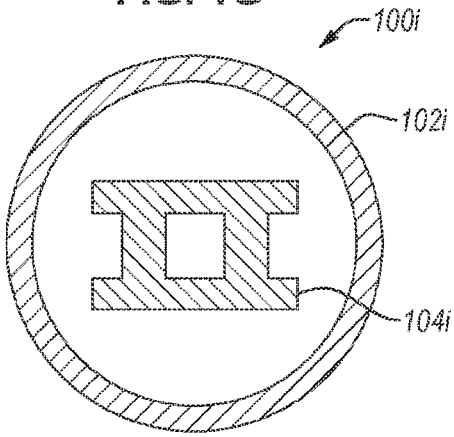

It is noted that any of the BRBs disclosed herein may include a casing and/or core exhibiting a different cross-sectional shape than the cross-sectional shapes shown in FIGS. 1B and 1C. For example, FIGS. D-1I are cross-sectional views of different BRBs, according to different embodiments. Except as otherwise disclosed herein, the BRBs shown in FIGS. 1D-1I are the same or substantially similar to any of the BRBs disclosed herein. FIG. 1D illustrates a BRB 100*d* including a casing 102*d* that is the same or substantially similar to the casing 102 of FIG. 1B. However, the BRB 100*d* including a core 104*d* exhibiting a generally rectangular cross-sectional shape, such as a hollow generally rectangular cross-sectional shape (e.g., the core 104*d* is a hollow structural section). FIG. 1E illustrates a BRB 100*e* including a casing 102*e* that is the same or substantially similar to the casing 102 of FIG. 1B. However, the BRB 100*e* may include a core 104*e* that is a double I-beam core. FIG. 1F illustrates a BRB 100*f* including a casing 102*f* exhibiting a hollow generally circular cross-sectional shape. The BRB 100*f* also includes a core 104*f* that is the same or substantially similar to the core 104 of FIG. 1B. FIG. 1G illustrates a BRB 100*g* including a casing 102*g* that is the same or substantially similar to the casing 102*f* of FIG. 1F. Also, the BRB 100*g* includes a core 104*g* that is the same or substantially similar to the core 104*c* of FIG. 1C. FIG. 1H illustrates a BRB 100*h* including a casing 102*h* that is the same or substantially similar to the casing 102*f* of FIG. 1F. Also, the BRB 100*h* includes a core 104*h* that is the same or substantially similar to the core 104*d* of FIG. 1D. FIG. 1I illustrates a BRB 100*i* including a casing 102*i* that is the same or substantially similar to the casing 102*f* of FIG. 1F. Also, the BRB 100*i* includes a core 104*i* that is the same or substantially similar to the core 104*e* of FIG. 1E. It is noted that the BRBs may include casings and/or cores exhibiting a different cross-sectional shape other than the cross-sectional shapes shown in FIGS. 1B-1I. For example, the casings of the BRBs disclosed herein may exhibit any suitable hollow cross-sectional shape and/or the cores of the BRBs disclosed herein may include a solid generally circular shape, one or more plates, cruciform or double cruciform beams, or any other suitable core.

Referring back to FIG. 1B, the core 104 may exhibit a first core dimension $D_{1Co}$ and a second outer core dimension $D_{2Co}$. The first and second core dimensions $D_{1Co}$ and $D_{2Co}$ are measured perpendicularly to a longitudinal axis of the core 104 and the second core dimension $D_{2Co}$ is measured perpendicularly to the first core dimension $D_{1Co}$. In an embodiment, as shown in FIG. 1B, the first core dimension $D_{1Co}$ and the second core dimension $D_{2Co}$ are the same. In an embodiment, as shown in FIG. 1C, the first core dimension $D_{1Co}$ is different (e.g., greater) than the second core dimension $D_{2Co}$.

The first core dimension $D_{1Co}$ and the second core dimension $D_{2Co}$ may be at least about 1 mm, at least about 2 mm, at least about 3 mm, at least about 4 mm, at least about 5 mm, at least about 7.5 mm, at least about 1 cm, at least about 1.5 cm, at least about 2 cm, at least about 3 cm, at least about 4 cm, at least about 5 cm, at least about 7.5 cm, at least about 10 cm, at least about 15 cm, at least about 20 cm, at least about 25 cm, at least about 30 cm, at least about 40 cm, at least about 50 cm, or in ranges of about 1 mm to about 3 mm, about 2 mm to about 4 mm, about 3 mm to about 5 mm, about 4 mm to about 7.5 mm, about 5 mm to about 1 cm, about 7.5 mm to about 1.5 cm, about 1 cm to about 2 cm, about 1.5 cm to about 3 cm, about 2 cm to about 4 cm, about 3 cm to about 5 cm, about 4 cm to about 7.5 cm, about 5 cm to about 10 cm, about 7.5 cm to about 15 cm, about 10 cm to about 20 cm, about 15 cm to about 25 cm, about 20 cm to about 30 cm, about 25 cm to about 40 cm, or about 30 cm to about 50 cm. The first core dimension $D_{1Co}$ and the second core dimension $D_{2Co}$ may be selected based on a number of factors. In an example, the first core dimension $D_{1Co}$ and the second core dimension $D_{2Co}$ may be selected based on the desired maximum tensile load that the core 104 is designed to withstand. For instance, increasing the first core dimension $D_{1Co}$ and the second core dimension $D_{2Co}$ increases the tensile load that the core 104 can resist with plastically deforming or otherwise failing. In an example, the first core dimension $D_{1Co}$ and the second core dimension $D_{2Co}$ may be selected based on the desired compressive axial force that the core 104 can withstand without buckling or otherwise failing. In an example, the first core dimension $D_{1Co}$ and the second core dimension $D_{2Co}$ may be selected based on the desired minimum gap distance "g" between the casing 102 and the core 104.

Referring back to FIG. 1B, in an embodiment, the core 104 may be disposed at or substantially near the middle of the interior region 106. In an embodiment, the core 104 may be asymmetrically disposed in the interior region 106 such that the core 104 is closer to one edge of the casing 102 than an opposing edge of the casing 102.

The BRB 100 exhibits an minimum gap distance "g" between the casing 102 and the core 104 (the minimum gap distance "g" is also shown in FIG. 1C). As previously discussed, the minimum gap distance "g" is the minimum distance between the casing 102 and the core 104 when the core 104 is disposed in the middle of the interior region 106 of the casing 102. The minimum gap distance "g" allows the BRB 100 to exhibit the desirable property of being able to resist equal or substantially equal compressive and tensile axial forces while minimizing (e.g., eliminating) the amount of cementitious material used in the BRB 100.

The size of the minimum gap distance "g" may depend on the size of the casing 102 and/or the size of the core 104. For example, the minimum gap distance "g" increases or decreases as the size of the casing 102 and/or core 104 increase or decrease, respectively. In an embodiment, the minimum gap distance "g" may be about 2% to about 49% of at least one of the first outer casing dimension $D_{1Ca}$ or the second outer casing dimension $D_{2Ca}$, such as in ranges of about 2% to about 4%, 3% to about 5%, about 4% to about 6%, about 5% to about 7%, about 6% to about 8%, about 7% to about 9%, about 8% to about 10%, about 9% to about 11%, about 10% to about 12%, about 11% to about 13%, about 12% to about 14%, about 13% to about 15%, about 14% to about 17%, about 16% to about 20%, about 18% to about 22%, about 20% to about 25%, about 23% to about 28%, about 25% to about 30%, about 28% to about 33%, about 30% to about 35%, about 33% to about 38%, about 35% to about 40%, about 38% to about 43%, about 40% to about 45%, or about 43% to about 49%.

In an embodiment, the minimum gap distance "g" may be at least about 2.54 cm, at least about 3 cm, at least about 3.5 cm, at least about 4 cm, at least about 4.5 cm, at least about 5 cm, at least about 6 cm, at least about 7 cm, at least about 8 cm, at least about 9 cm, at least about 10 cm, at least about 12 cm, at least about 15 cm, or in ranges of about 2.5 cm to about 3.5 cm, about 3 cm to about 4 cm, about 3.5 cm to about 4.5 cm, about 4 cm to about 5 cm, about 4.5 cm to about 6 cm, about 5 cm to about 7 cm, about 6 cm to about 8 cm, about 7 cm to about 9 cm, about 8 cm to about 12 cm, about 10 cm to about 15 cm, about 10 cm to about 17 cm, or about 15 cm to about 20 cm.

The size of the minimum gap distance "g" may depend on a number of factors. In an example, as previously discussed, the size of the minimum gap distance "g" may depend on the size of the casing 102 and/or the size of the core 104. In an example, the minimum gap distance "g" may depend on the maximum tensile axial force that the core 104 can resist without plastically yielding or otherwise failing since increasing the maximum tensile load of the core 104 may require an increased size in the casing 102. In an example, the minimum gap distance "g" may depend on the moment of inertia of the core 104 because increasing the moment of inertia of the core 104 may allow the BRB 100 to include a casing 102 exhibiting a small cross-sectional area. In an example, the minimum gap distance "g" may depend on the length of the casing 102 and/or the core 104 since the ability of the casing 102 and the core 104 to resist buckling is directly proportional to the inverse of the length thereof squared.

As previously discussed, the BRB 100 is configured to minimize the amount of cementitious material that is used therein compared to a substantially similar conventional BRB. In an embodiment, the BRB 100 may be substantially free of cementitious material. As used herein, substantially free of cementitious material means that the BRB 100 includes structurally insignificant amount of cementitious material and/or the BRB 100 only include inadvertent contamination of cementitious material caused, for example, by the BRB 100 be manufactured, shipped, stored, and/or used in locations were cementitious materials are used. In an embodiment, the BRB 100 may include some amount of cementitious material. For example, the cementitious material may form two of the caps formed of cementitious material as discussed below or may be used to form a rust and/or thermal insulating layer on one or more components of the BRB 100. However, when the BRB 100 includes some cementitious material, the cementitious material occupies at most about 50% of the volume between the casing 102 and the core 104, and more preferable occupies at most about 25% and even more preferable occupies at most 10% of the volume between the casing 102 and the core 104.

In the illustrated embodiment, the BRB 100 does not include any structure that supports and/or suspends (hereafter simply referred to as "support") the core 104 in the interior region 106 casing 102. As such, the casing 102 may rest on and directly contact the core 104. However, resting the casing 102 on the core 104 may at least one of affect how the core 104 buckles or increase the likelihood that the core 104 buckles. As such, in an embodiment, the BRB 100 may include a support structure (not shown) that supports the core 104 in the interior region 106 which may at least partially alleviate some of the problems associated with resting the casing 102 on the core 104. The support structure may include any suitable support structure.

In an embodiment, the support structure that suspends the core 104 in the interior region 106 may include two caps at and/or near each terminal end 108 of the casing 102. The two caps may be attached to the casing 102 and may extend between the casing 102 and the core 104 thereby supporting the core 104 in the interior region 106. The caps may also be attached to the core 104, weakly attached to the core 104 such that the attachment fails when the core 104 buckles, or may not be attached to the core 104 thereby allowing the core 104 to freely move relative to the caps. The caps may be formed from any suitable material. For example, the caps may be metal plates or cementitious material. The caps may be simple to form compared to other support structures commonly found in conventional BRB since the caps are only located at and/or near the terminal ends 108 of the casing 102. The caps also allow the BRB to include the minimum gap distance "g" along at least a portion (e.g., a majority) of the first length of the casing 102.

In an embodiment, the support structure includes a plurality of protrusions attached to or integrally formed with the casing 102 located at and/or near the terminal ends 108 of the casing 102. Similar to the caps, the plurality of protrusions extend between the casing 102 and the core 104 thereby supporting the core 104 in the interior region 106. Generally, the plurality of protrusions are not attached or are only weakly attached to the core 104. The protrusions only extend along a portion of the first length of the casing 102 that is at and/or near the terminal ends 108 of the casing 102. Extending the protrusions along only a portion of the first length makes the protrusions significantly easier to attach to the casing 102 than if the protrusions extends along all of the first length. Also, extending the protrusions along only a portion of the first length allow the BRB to include the minimum gap distance "g" along at least a portion (e.g., a majority) of the first length of the casing 102.

Figure 2A:
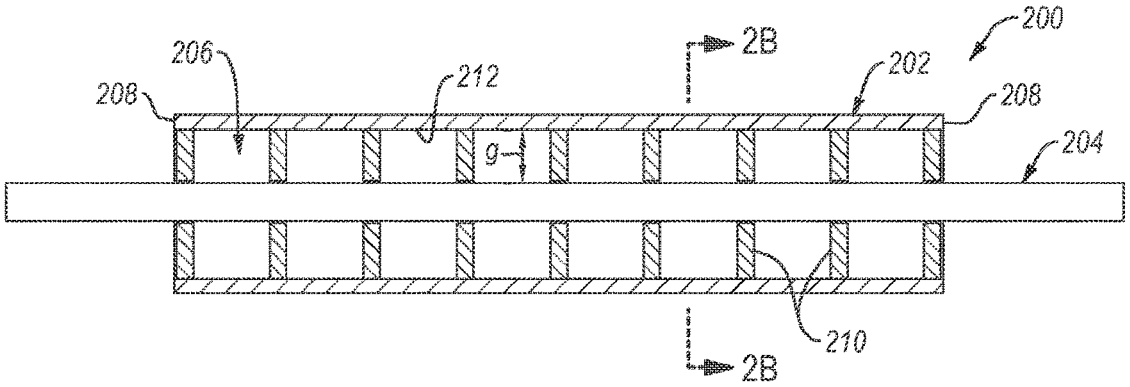
FIG. 2A is a partial cross-sectional view of a BRB that includes a plurality of bridge plates, according to an embodiment.
Figure 2B:
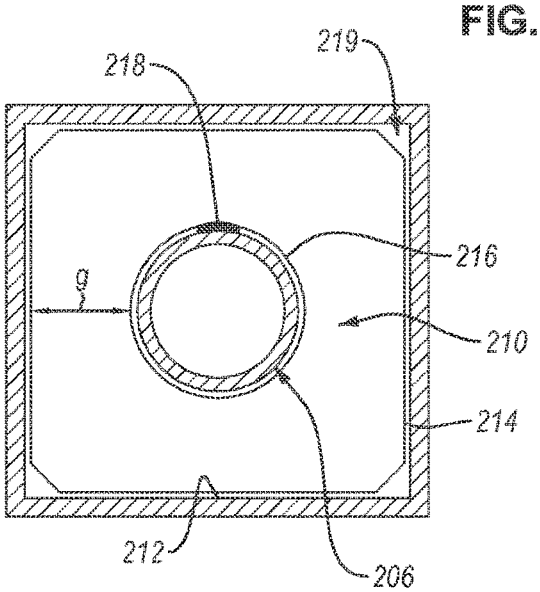
FIG. 2B is a cross-sectional view of the BRB taken along line 2B-2B shown in FIG. 2A, according to an embodiment.

In an embodiment, the support structure may include a plurality of bridge plates. For example, FIG. 2A is a partial cross-sectional view of a BRB 200 that includes a plurality of bridge plates 210, according to an embodiment. FIG. 2B is a cross-sectional view of the BRB 200 taken along line 2B-2B shown in FIG. 2A, according to an embodiment. Except as otherwise disclosed herein, the BRB 200 is the same or substantially similar to any of the BRBs disclosed herein. For example, the BRB 200 includes a casing 202 having a first length, a core 204 having a second length, and an minimum gap distance "g" along at least a portion of the first length of the casing 202.

Each of the plurality of bridge plates 210 are configured to extend between the casing 202 and the core 204 when the core 204 is disposed in the interior region 206 such that the bridge plates 210 support the core 204 in the interior region 206. Each of the bridge plates 210 may be configured to fit in the interior region 206 of the casing 202. As such, as illustrated, an outer periphery 214 the bridge plates 210 may exhibit a shape that generally corresponds to a shape formed by at least one interior surface 212 of the casing 202. The bridge plates 210 also define an opening 216 therein that is configured to have the core 204 positioned therethrough. The opening 216 allows the core 204 to be positioned through each of the bridge plates 210. The opening 216 may exhibit a shape that at least generally corresponds to the cross-sectional shape of the core 204 which allows the core 204 to be positioned therethrough. At least some (e.g., each) of the bridge plates 210 are longitudinally spaced from each other along the longitudinal axis of the casing 202 and/or the longitudinal axis of the core 204.

In an embodiment, the BRB 200 is formed by positioning the bridge plates 210 around the core 204 at different locations along the core 204. To facilitate positioning the bridge plates 210 around the core 204, the opening 216 may be slightly larger than a cross-sectional shape of the core 204. For example, the opening 216 may exhibit a dimension (not shown) that is larger than a corresponding dimension (e.g., at least one of the first core dimension or the second core dimension) by at most about 15 mm, at most about 10 mm, at most about 7.5 mm, at most about 6 mm, at most about 5 mm, at most about 4 mm, at most about 3 mm, at most about 2 mm, at most about 1 mm, or in ranges of about 1 mm to about 3 mm, about 2 mm to about 4 mm, about 3 mm to about 5 mm, about 4 mm to about 6 mm, about 5 mm to about 7.5 mm, about 6 mm to about 10 mm, or about 7.5 mm to about 15 mm. The above differences in the dimension of the opening 216 and the corresponding dimension of the core 204 allows the bridge plates 210 to be easily positioned along the core 204 while preventing the core 204 from significantly moving in a direction that is perpendicular to a longitudinal axis thereof from a desired location within the interior region 206. The difference between the dimension of the opening 216 and the corresponding dimension of the core 204 may be selected based on the size of the corresponding dimension of the core 204 and the thickness of the bridge plate 210, wherein increasing the corresponding dimension of the core 204 and/or the thickness of the bridge plate 210 may require an increase in the dimension of the opening 216 relative to the corresponding dimension of the core 204. It is noted that the corresponding dimension of the core 204 is the dimension that overlaps and is parallel to the dimension of the opening 216 when the core 204 is disposed in the center of the opening 216 and the core 204 is not rotated relative to the opening 216 (e.g., any gap between the core 204 and the opening 216 is as uniform as possible).

Figure 2C:
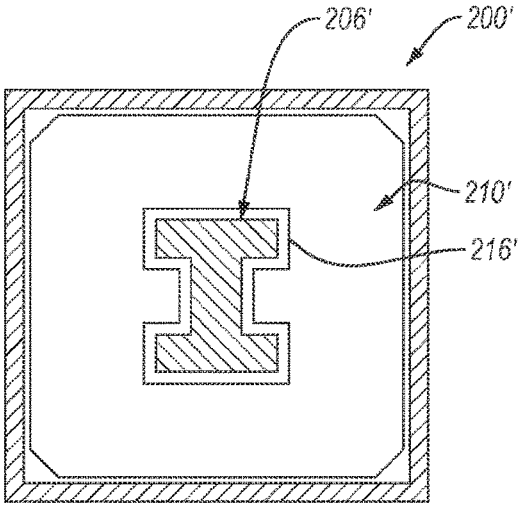
FIG. 2C is a cross-sectional view of a BRB that includes a core that is an I-beam, according to an embodiment.

In FIG. 2B, the cross-sectional shape of the core 204 and the shape of the opening 216 are both circular. However, as previously discussed, the core 204 may exhibit cross-sectional shapes other than a circular cross-sectional shape. For example, FIG. 2C is a cross-sectional view of a BRB 200' that includes a core 204' that is an I-beam, according to an embodiment. Except as otherwise disclosed herein, the BRB 200' is the same as or substantially similar to the BRB 200 of FIGS. 2A and 2B. Since the core 204' exhibits a generally I cross-sectional shape, the opening 216' of the bridge plate 210' also exhibits a generally I cross-sectional shape that is slightly larger than the generally I cross-sectional shape of the core 204'.

Referring back to FIGS. 2A and 2B, it is generally desirable that the core 204 be allowed to move relative to the bridge plates 210 when the core 204 buckles. Otherwise, buckling of the core 204 may cause the bridge plates 210 to move relative to the casing 202 which may cause the bridge plates 210 to gouge or otherwise weaken the casing 202. In an embodiment, the core 204 may not be attached to the bridge plates 210 thereby allowing the core 204 to move relative to the bridge plates 210 when the core 204 buckles. However, the bridge plates 210 may be positioned adjacent to a selected portion of the core 204 and not attaching the core 204 to the bridge plates 210 may make maintaining the bridge plates 210 adjacent to the selected portion of the core 204 during assembly and handling of the BRB 200 difficult. As such, the bridge plates 210 may be attached to the core 204. In an example, as shown, a weld 218 is formed between corresponding first portions of the core 204 and the opening 216 while corresponding second portions of the core 204 and the opening 216 are not attached together with the weld 218. The second portions of the core 204 and the opening 216 may be significantly larger than the first portion of the core 204 and the opening 216 such that the weld 218 is sufficient to maintain the position of the bridge plate 210 relative to the core 204 during assembly and handling. The weld 218 may or may not fail when the core 204 buckles. In an example, at least substantially all of the outer periphery of the core 204 is welded to corresponding portions of the opening 216. In an example, a polymer is positioned between the core 204 and the opening 216 and maintains the position of the bridge plate 210 relative to the core 204. The polymer may or may not fail or otherwise become detached from at least one of the core 204 or the bridge plate 210 when the core 204 buckles.

In an embodiment, the BRB 200 is formed by positioning the core 204 with the bridge plates 210 positioned thereabout in the interior region 206. To facilitate positioning the core 204 and the bridge plates 210 in the interior region 206, each of the bridge plates 210 may be slightly smaller than a cross-sectional shape of the interior region 206 as defined by the interior surface 212 of the casing 202. For example, each bridge plate 210 may exhibit a dimension (not shown) that is smaller than a corresponding dimension of the interior region 206 (e.g., at least one of the first interior region dimension or the second interior region dimension) by at most about 25 mm, at most about 20 mm, at most about 15 mm, at most about 10 mm, at most about 7.5 mm, at most about 6 mm, at most about 5 mm, at most about 4 mm, at most about 3 mm, at most about 2 mm, at most about 1 mm, or in ranges of about 1 mm to about 3 mm, about 2 mm to about 4 mm, about 3 mm to about 5 mm, about 4 mm to about 6 mm, about 5 mm to about 7.5 mm, about 6 mm to about 10 mm, about 7.5 mm to about 15 mm, about 10 mm to about 20 mm, or about 15 mm to about 25 mm. The above differences in the dimension of the bridge plate 210 and the corresponding dimension of the interior region 206 allows the bridge plates 210 to be easily positioned within the interior region 206 while preventing the bridge plates 210 from gouging or becoming stuck during assembly. The difference between the dimension of the bridge plates 210 and the corresponding dimension of the interior region 206 may be selected based on the size of the corresponding dimension of the interior region 206 and the thickness of the bridge plate 210, wherein increasing the corresponding dimension of the interior region 206 and/or the thickness of the bridge plate 210 may require an increase in the dimension of the bridge plate 210 relative to the corresponding dimension of the interior region 206. It is noted that the corresponding dimension of the interior region 206 is the dimension that overlaps and is parallel to the dimension of the bridge plate 210 when the bridge plate 210 is disposed in the center of the interior region 206 and the bridge plate 210 is not rotated relative to the interior region 206 (e.g., any gap between the bridge plate 210 and the interior surface 212 defining the interior region 206 is as uniform as possible).

In an embodiment, each of the plurality of bridge plates 210 are not attached to the casing 202. In such an embodiment, not attaching the bridge plates 210 to the casing 202 may facilitate movement of the core 204 relative to the casing 202 when the core 204 buckles since the core 204 can move relative to the casing 202 even when the core 204 gets stuck to one of the bridge plates 210. Further, it may be difficult to attach the bridge plates 210 that are spaced from the terminal ends 208 of the casing 202.

In an embodiment, one or more of the plurality of bridge plates 210 are attached to the casing 202. For example, the ones of the plurality of bridge plates 210 that are at or nearest the terminal ends 208 may be attached to the casing 202. Attaching the ones of the plurality of bridge plates 210 that are at or nearest the terminal ends 208 may be significantly easier to attach to the casing 202 that other ones of the plurality of bridge plates 210. Also, attaching the ones of the plurality of bridge plates 210 that are at or nearest the terminal ends 208 may maintain the other ones of the bridge plates 210 within the interior region 206 even when the other ones of the bridge plates 210 move.

In an embodiment, the bridge plates 210 may define one or more cutouts 219. The cutouts 219 are variations in the shape of the bridge plates 210 relative to the cross-sectional shape of the interior region 206. In an example, the cutouts 219 may blunt or remove sharp corners from the bridge plate 210, as shown in FIG. 2B. For example, sharp corners are more likely to contact and become stuck against the casing 202 when the bridge plate 210 is positioned within the interior region 206. However, cutouts 219 that blunt or remove the sharp corners minimize such contact. As such, the cutouts 219 facilitate forming the BRB 200. In an example, the cutouts 219 may decrease the weight of the bridge plate 210 thereby decreasing the overall weight of the BRB 200.

The BRB 200 may include any suitable number of bridge plates 210. For example, the BRB 200 may include at least 2, at least 3, at least 4, at least 5, at least 6, at least 7, at least 8, at least 9, at least 10, at least 12, at least 15, at least 20, at least 30, at least 40, at least 50, at least 60, at least 70, at least 80, at least 90, or at least 100 bridge plates 210, such as in ranges of 2 to 4 bridge plates 210, 3 to 5 bridge plates 210, 4 to 6 bridge plates 210, 5 to 7 bridge plates 210, 6 to 8 bridge plates 210, 7 to 9 bridge plates 210, 8 to 10 bridge plates 210, 9 to 12 bridge plates 210, 10 to 15 bridge plates 210, 12 to 20 bridge plates 210, 15 to 25 bridge plates 210, 20 to 30 bridge plates 210, 25 to 40 bridge plates 210, 30 to 50 bridge plates 210, 40 to 50 bridge plates 210, 40 to 60 bridge plates 210, 50 to 70 bridge plates 210, 60 to 80 bridge plates 210, 70 to 90 bridge plates 210, 80 to 100 bridge plates 210, 90 to 150 bridge plates 210, or 120 to 200 bridge plates 210. The number of bridge plates 210 that are present in the BRB 200 affect the average spacing between the bridge plates 210. For example, increasing the number of bridge plates 210 in the BRB 200 decreases the average spacing between bridge plates 210 and decreasing the number of bridge plates 210 in the BRB 200 increase the average spacing between the bridge plates 210. Also, increasing the first length of the casing 202 increases the average spacing between the number of bridge plates 210 and, as such, the number of bridge plates 210 that are present in the BRB 200 may depend on the first length of the casing 202.

The average spacing between the bridge plates 210 may have a significant effect on the ability of the core 204 to resist buckling. For example, the ability of the core 204 to resist buckling is inversely proportional to the length of the core 204 squared. As such, increasing the length of the core 204 drastically decreases the ability of the core 204 to resist buckling. However, the bridge plates 210 may increase the ability of the core 204 to resist buckling by effectively breaking the core 204 into a plurality of portions and the length of the plurality of portions determines the ability of the core 204 to resist buckling. As such, the bridge plates 210 may drastically increase the ability of the core 204 to resist buckling. Increasing the ability of the core 204 to resist buckling due to the presence of the bridge plates 210 may have a cascading effect on the design of the BRB 200. For example, the increased ability of the core 204 to resist buckling increases the ability of the BRB 200 to resist compressive axial forces. Thus, the bridge plates 210 may allow the casing 202 to be smaller while still allowing the BRB 200 to resist an equal or substantially equal magnitude in the compressive and tensile axial forces.

In an embodiment, the bridge plates 210 are equidistantly spaced apart such that the average distant between adjacent ones of the bridge plates 210 is the same as the actual distance between equal pair of adjacent bridge plates 210. In such an embodiment, the core 204 resists buckling to the same or substantially the same degree along the entire second length of the core 204. In an embodiment, the bridge plates 210 are not equidistantly spaced apart. For example, the bridge plates 210 may include at least one first pair of adjacent bridge plates and at least one second pair of adjacent bridge plates. The first pair of adjacent bridge plates may have a first spacing therebetween and the second pair of adjacent bridge plates may have a second spacing therebetween that is less than the first spacing. As such, the portion of the core 204 between the first pair of adjacent bridge plates is more likely to buckle than the portion of the core 204 between the second pair of adjacent bridge plates. As such, the first and second pair of adjacent bridge plates may be used to select which portion of the core 204 buckles initially which, in some embodiments, may be beneficial. In an example, it may be beneficial for the core 204 to buckle at a location at or near at least one of the terminal ends 208 of the casing 202. In such an example, the first pair of adjacent bridge plates may be at or near at least one of the terminal ends 208 while the second pair of adjacent bridge plates may be spaced from at least one of the terminal ends 208. In an example, it may be beneficial for the core 204 to buckle at a location that is spaced from the terminal ends 208 since avoiding buckling near the terminal ends 208 may decrease demands on the connection between the BRB 200 and a frame (e.g., frame 320 of FIG. 3). In such an example, the first pair of adjacent bridge plates may be spaced from the terminal ends 208 while the second pair of adjacent bridge plates may be at or near the terminal ends 208.

Figure 3:
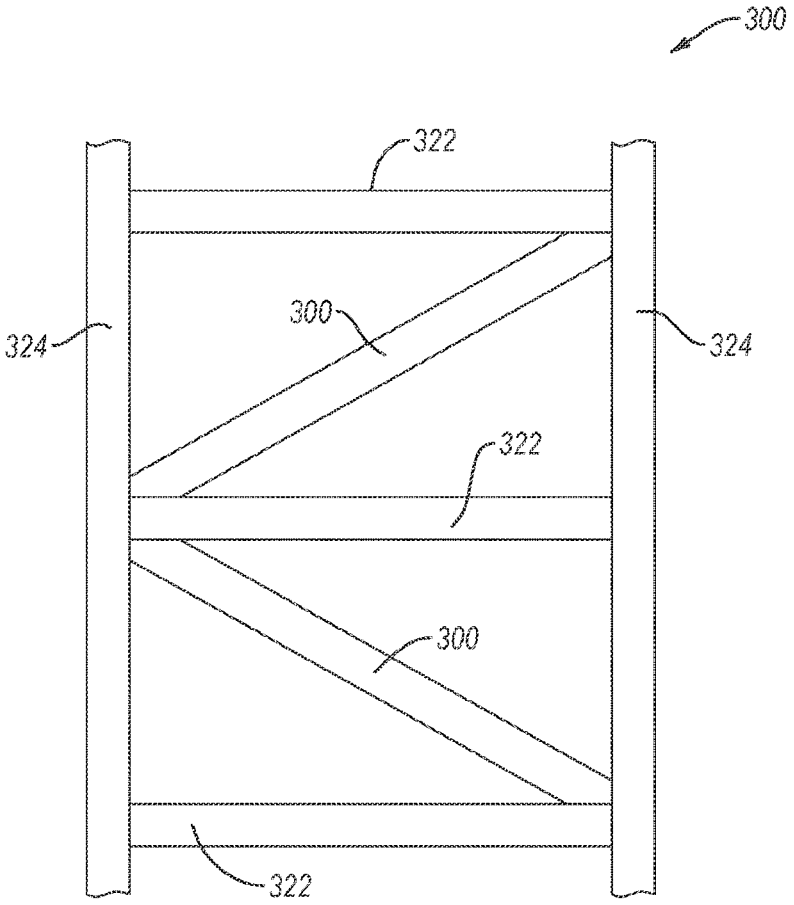
FIG. 3 is a schematic illustration of a frame, according to an embodiment.

As previously discussed, the BRBs disclosed herein may be used in a frame. FIG. 3 is a schematic illustration of a frame 320, according to an embodiment. The frame 320 may include one or more horizontally oriented beams 322 connected to and extending between opposing vertical columns 324. Each beam 322 may be connected to one of the columns 324 using any suitable connection. The frame 320 also includes one or more BRBs 300 that is the same or substantially similar to any of the BRBs disclosed herein. The BRBs 300 extend diagonally between the vertical columns 324 and/or the horizontally oriented beams 322. The BRBs 300 may be connected to the vertical columns 324 and/or the horizontally oriented beams 322 using any suitable connection.

In an embodiment, application of a force to the frame 320, for example during a seismic event, may produce movement (e.g., bending, twisting, and/or tilting) of the frame 320. The movement of the frame 320 may apply a compressive axial force, a tensile axial force, or alternating compressive and tensile axial forces to the BRBs 300. For instance, tilting the frame 320 shown in FIG. 3 to the side may apply a compressive axial force to one of the BRBs 300 shown in FIG. 3 and a tensile axial force to the other BRB 300 shown in FIG. 3. However, since the BRBs 300 are able to resist an equal or substantially equal magnitude of compressive and tensile axial forces, the BRBs 300 are able to withstand both the compressive and tensile axial forces.

While various aspects and embodiments have been disclosed herein, other aspects and embodiments are contemplated. The various aspects and embodiment disclosed herein are for purposes of illustration and are not intended to be limiting. Also, terms of degree (e.g., about) indicate structurally insignificant variations or variations of at most ±10% or at most ±5%.

I claim:

1. A buckling restrained brace, comprising:

a casing exhibiting a hollow cross-sectional shape defining an interior region, the casing exhibiting a first length, the casing including substantially only a steel or aluminum hollow structural section; and a core disposed in the interior region of the casing, the core exhibiting a generally I cross-sectional shape, the core exhibiting a second length that is greater than the first length;

wherein the casing is configured to restrain buckling of the core; and wherein the core is separated from the casing by an unoccupied space along at least a portion of the first length of the casing and a corresponding portion of the second length of the core, and wherein the unoccupied space is present between a minimum gap measured from flanges of the core and the casing when the core is disposed at or substantially near the middle of the interior region, and wherein the minimum gap distance is at least about 2.54 cm.

2. The buckling restrained brace of claim 1, wherein the unoccupied space exhibits a minimum gap distance between the core and the casing that is about 2% to about 49% of at least one outer dimension of the casing, the at least one outer dimension of the casing measured from an outer surface of the casing to an opposing outer surface of the casing, the at least one outer dimension of the casing measured perpendicularly to a longitudinal axis of the casing.

3. The buckling restrained brace of claim 1, wherein the casing exhibits at least one outer casing dimension measured perpendicularly to a longitudinal axis thereof that is about 2.5 cm to about 12 cm, the at least one outer dimension of the casing measured from an outer surface of the casing to an opposing outer surface of the casing, the at least one outer dimension of the casing measured perpendicularly to a longitudinal axis of the casing.

4. The buckling restrained brace of claim 1, wherein the first length of the casing is about 1 m to about 2.5 m.

5. The buckling restrained brace of claim 1, further comprising a plurality of bridge plates that each extend substantially between the core and the casing, wherein the at least a portion of the first length of the casing and the corresponding portion of the second length of the core is between adjacent ones of the plurality of bridge plates.

6. The buckling restrained brace of claim 5, wherein each of the plurality of bridge plates exhibiting a generally rectangular cross-sectional shape exhibiting a shape that is similar to and is smaller than a generally rectangular shaped cross-section of the interior region of the casing.

7. The buckling restrained brace of claim 5, wherein each of the plurality of bridge plates define an opening therethrough and the core is dispose through the opening, wherein a first portion of the opening is attached to the core only with a weld and a second portion of the opening is not attached to the core.

8. The buckling restrained brace of claim 1, wherein the buckling restrained brace is substantially free of one or more cementitious materials.

9. The buckling restrained brace of claim 1, wherein the unoccupied space is occupied by air.

10. A buckling restrained brace, comprising:

a single casing exhibiting a hollow cross-sectional shape defining an interior region, the single casing exhibiting a first length; and a single core disposed in the interior region of the single casing, the single core exhibiting a second length that is greater than the first length; and wherein the single casing is configured to restrain buckling of the core;

wherein the single core is separate from the single casing along at least a portion of the first length of the single casing and a corresponding portion of the second length of the single core by a minimum gap distance between the single core and the single casing that is about 2% to about 49% of at least one outer dimension of the single casing, the at least one outer dimension of the casing measured from an outer surface of the casing to an opposing outer surface of the casing, the at least one outer dimension of the casing measured perpendicularly to a longitudinal axis of the casing, and wherein the minimum gap distance is an unoccupied space, and wherein the minimum gap distance is at least about 2.54 cm.

11. The buckling restrained brace of claim 10, wherein the single core exhibits a generally I cross-sectional shape or a hollow circular cross-sectional shape.

12. The buckling restrained brace of claim 10, further comprising a plurality of bridge plates that each extend substantially between the single core and the single casing, wherein the at least a portion of the first length of the single casing and the corresponding portion of the second length of the single core is between adjacent ones of the plurality of bridge plates.

13. A frame, comprising:

opposing vertical columns;

one or more horizontally oriented beams connected to and extending between opposing vertical columns; and at least one buckling restrained brace extending in a diagonal direction, the at least one buckling restrained brace including the buckling restrained brace of claim 1.

14. A frame, comprising:

opposing vertical columns;

one or more horizontally oriented beams connected to and extending between opposing vertical columns; and at least one buckling restrained brace extending in a diagonal direction, the at least one buckling restrained brace including the buckling restrained brace of claim 10.

* * * * *